US005139400A

United States Patent [19]

Ide

[11] Patent Number: 5,139,400

[45] Date of Patent: Aug. 18, 1992

[54] PROGRESSIVE CAVITY DRIVE TRAIN

[76] Inventor: Russell D. Ide, 28 Daniel Dr., Conventry, R.I. 02816

[21] Appl. No.: 420,019

[22] Filed: Oct. 11, 1989

[51] Int. Cl.[5] ..... F01C 1/10

[52] U.S. Cl. ..... 418/48; 175/107; 464/102

[58] Field of Search ..... 418/48, 182; 464/102, 464/137; 175/107

[56] References Cited

U.S. PATENT DOCUMENTS

| | | | |
|---|---|---|---|
| Re. 29,626 | 5/1978 | Allen | 241/46.11 |
| 481,780 | 8/1889 | Brown . | |
| 643,081 | 2/1900 | Bullock | 464/137 |
| 2,898,087 | 8/1959 | Clark | 175/107 |
| 2,915,979 | 12/1959 | Bourke et al. . | |
| 2,924,180 | 2/1960 | Bourke et al. . | |
| 3,063,265 | 11/1962 | Schmidt | 64/31 |
| 3,097,609 | 7/1963 | Nechine . | |
| 3,165,065 | 1/1965 | Stickel . | |
| 3,216,768 | 11/1965 | Soeding et al. | 418/48 |
| 3,242,694 | 3/1966 | Schmidt | 64/19 |
| 3,280,753 | 10/1966 | Zimmer | 418/48 |
| 3,407,628 | 10/1968 | Eccher | 464/137 |
| 3,567,348 | 3/1971 | Benson | 418/48 |
| 3,612,734 | 10/1971 | Dawson et al. | 418/48 |
| 3,664,153 | 5/1972 | Sugahara | 64/31 |
| 3,840,080 | 10/1974 | Berryman | 175/107 |
| 3,877,259 | 4/1975 | Bishop | 64/29 |
| 3,938,744 | 2/1976 | Allen | 241/46.11 |
| 4,080,115 | 3/1978 | Sims et al. | 418/48 |
| 4,140,444 | 2/1979 | Allen | 418/48 |
| 4,153,397 | 5/1979 | Allen | 418/48 |
| 4,237,704 | 12/1980 | Varadan | 418/182 |
| 4,311,443 | 1/1982 | Clark et al. | 418/48 |
| 4,329,127 | 5/1982 | Tschirky et al. | 418/48 |
| 4,397,619 | 8/1983 | Alliquander et al. | 418/48 |
| 4,443,165 | 4/1984 | Chanton | 418/48 |
| 4,449,953 | 5/1984 | Nikomarov et al. | 464/19 |
| 4,484,899 | 11/1984 | Haarmann | 464/69 |
| 4,591,322 | 5/1986 | Ono et al. | 418/48 |
| 4,599,056 | 7/1986 | Crase | 418/48 |
| 4,632,193 | 12/1986 | Geczy | 175/65 |
| 4,636,151 | 1/1987 | Eppink | 418/48 |
| 4,643,047 | 2/1987 | Distin et al. | 74/304 |
| 4,679,638 | 7/1987 | Eppink | 175/107 |
| 4,693,325 | 9/1987 | Bodine | 175/55 |
| 4,824,258 | 4/1989 | Bodine | 366/118 |

FOREIGN PATENT DOCUMENTS

| | | |
|---|---|---|
| 1213742 | 3/1966 | Fed. Rep. of Germany . |
| 1233667 | 2/1967 | Fed. Rep. of Germany . |
| 469903 | 4/1969 | Fed. Rep. of Germany . |
| 583166 | 7/1925 | France . |
| 788103 | 10/1935 | France . |
| 535266 | 2/1955 | France . |
| 3611373 | 11/1984 | U.S.S.R. . |
| 2152588A | 8/1985 | United Kingdom . |

OTHER PUBLICATIONS

"Ingenious Mechanisms for Designers and Inventors", vol. IV, pp. 407–409 (1967).

Patent Abstracts of Japan: vol. 14, No. 157, Mar. 27, 1990 relating to Appl. No. 63-166824 (Jul. 6, 1988) (Ebara Corp.).

*Primary Examiner*—Richard A. Bertsch
*Assistant Examiner*—Michael I. Kocharov
*Attorney, Agent, or Firm*—Marks & Murase

[57] ABSTRACT

A progressive cavity drive train which includes a progressive cavity device and a coupling for converting the complex motion of the rotor into simple rotation. The coupling includes two offset shafts coupled to one another by offset lug members. The drive train can be used to convert fluid pressure into rotation of a drill bit in a drilling apparatus. Alternatively, the drive train can be used to convert driving rotation from a motor or engine into fluid pumping action of the progressive cavity device.

19 Claims, 9 Drawing Sheets

PROGRESSIVE CAVITY DRIVE TRAIN

BACKGROUND OF THE INVENTION

This invention relates to a progressive cavity apparatus, and more particularly to drive trains for progressive cavity devices and to progressive cavity driving, drilling, and pumping apparatus.

The use of progressive cavity or single-screw rotary devices is well known in the art, both as pumps and as driving motors. These devices have a single shaft in the shape of one or more helix contained within the cavity of a flexible lining of a housing. The generating axis of the helix constitutes the true center of the shaft. This true center of the shaft coincides with its lathe or machine center. The lined cavity is in the shape of a two or more helices (one more helix than the shaft) with twice the pitch length of the shaft helix One of the shaft or the housing is secured to prevent rotation; the part remaining unsecure rolls with respect to the secured part. As used herein, rolling means the normal motion of the unsecured part of progressive cavity devices. In so rolling, the shaft and housing form a series of sealed cavities which are 180 degrees apart. As one cavity increases in volume, its counterpart cavity decreases in volume at exactly the same rate. The sum of the two volumes is therefore a constant.

When used as a pump, the unsecured part, whether shaft or housing, is rotated by external forces so as to roll with respect to the secured part. Fluids entering the housing are pumped through it by the progressing cavities. When used as a motor, the unsecured part, whether shaft or housing, rolls with respect to the secured part in response to fluids flowing through the housing. Whether the progressive cavity device is used as a motor or a pump, the part that is unsecured and free to rotate is known generally as the rotor and the secured part is known generally as the stator. Optimum performance is obtained when movement of rotor is precisely controlled such that the rotor rolls precisely along the stator.

When used as a motor, the unsecured part or rotor produces a rotor driving motion The driving motion of the rotor is quite complex in that it is simultaneously rotating and moving transversely with respect to the stator. One complete rotation of the rotor will result in a movement of the rotor from one side of the stator to the other side and back. The true center of the rotor will of course rotate with the rotor. However, the rotation of the true center of the rotor traces a circle progressing in the opposite direction to the rotation of the rotor, but with the same speed (i.e., reverse orbit) Again, optimum performance is obtained when movement of the rotor is precisely controlled. One complete rotation of the rotor will result in one complete rotation of the true center of the rotor in the opposite direction. Thus, the rotor driving motion is simultaneously a rotation, an oscillation, and a reverse orbit. For multi-lobe motors the reverse orbit is a multiple of the rotational speed, e.g., if a three lobe motor is used the reverse orbit is three times as great as the rotational speed.

Examples of progressive cavity motor and pump devices are well known in the art. The construction and operation of such devices may be readily seen in U.S. Pat. Nos. 3,627,453 to Clark (1971); 2,028,407 to Moineau (1936); 1,892,217 to Moineau (1932) and 4,080,115 to Sims et al. (1978).

Despite the simple construction of progressive cavity devices, use of the devices as motors in driving and drilling apparatus have proven difficult. This difficulty results primarily from the failure to provide a drive train capable of handling the complex rotor driving motion (described above) in a durable, reliable and inexpensive manner. This is further complicated because the drive train must handle large torques.

Of course, there are many known couplings which involve an orbiting member. For example, in U.S. Pat. No. 3,242,644 there is disclosed a torque transmitting device which is made up of three rotary members and two sets of at least three link members journaled in sleeve bearings fixed to the rotary members. Each link member is in the form of two integrally connected axially offset shaft sections. However, such couplings have not heretofore been adapted to progressive cavity devices.

Attempts have been made to convert the complex rotor motion into rotational motion for driving or driven drilling. Of the couplings which have been used in progressive cavity devices, the most commercially successful has been a universal joint attached to the driving or driven end of the rotor and connected to a universal joint attached to the driven drill shaft or pump driving shaft. This approach suffers from several disadvantages, particularly in the area of reliability. For instance, the universal joint tends to fail quickly if run in abrasive environments. The fluids used in progressive cavity drilling apparatus often are or quickly become abrasive Additionally, the universal joint does not control rotor location Generally, the universal joint simply follows the motion of the rotor and does not precisely control the rotor. Consequently, the rotor motion within the stator is somewhat imprecise or sloppy. This causes fluid leakage and power loss. Moreover, a universal joint can only accommodate a certain amount of misalignment per unit length. A universal joint which is long enough to accommodate rotor motion adds significantly to the length of the drilling motor and thereby restricts the ability to drill directionally.

Other known progressive cavity devices employ couplings which are complex and expensive For instance, the aforementioned Sims et al. patent discloses an arrangement providing means directly connecting the rotational and reverse orbiting motion of the rotor to a rotational motion substantially about a single axis whereby the two motions are at different speeds. The connecting means is attached to the rotor and at least a portion of the connecting means is aligned with the true center of the rotor for rotation substantially about the single axis. When the progressive cavity device is used as a motor for drilling, the connecting means attached to the rotor converts the driving motion of the rotor into slower rotational driving motion substantially about a single axis. In some instances, the variation in speed and complexity of this design can cause problems in terms of reliability and durability. Moreover, Sims et al. uses gears to transmit torque; these gears are relatively expensive and can cause friction associated energy loss unless carefully lubricated and maintained.

SUMMARY OF THE INVENTION

The present invention obviates the problems associated with known progressive cavity devices by providing a progressive cavity drive train including a progressive cavity device and a cam coupling which converts the complex motion of the rotor into simple rotation.

The drive train is inexpensive, reliable and durable in comparison to known progressive cavity drive trains. Moreover, the movement of the rotor is precisely controlled to optimize performance by, among other things, providing a better rotor-stator interface, providing a tighter seal between cavities and permitting the use of a bearing support for the non-orbiting driving or driven member immediately adjacent the coupling. The drive train of the present invention can be used to convert fluid pressure into mechanical rotation (as in a fluid drive for down hole drilling) or to convert mechanical rotation into fluid pressure (as in a Moyno pump).

Specifically, the present invention provides a progressive cavity drive train which includes a housing structure, a stator having a longitudinal axis, a rotor having a true center and being located within the stator, first and second stub shafts and offset cam lug members coupling the stub shafts.

The stator and the rotor having coacting helical lobes in contact with one another at any transverse section. The stator has one more helical lobe than the rotor such that a plurality of cavities are defined between the rotor and the stator. The rotor is adapted to rotate within the stator such that the true center of the rotor orbits the axis of the stator; the orbit has a predetermined radius. Significantly, the orbit is constant and not subject to change such that the rotor motion can be precisely controlled. The orbit of the rotor causes a progression of the cavities in the direction of the axis of the stator.

The first stub shaft has a longitudinal axis and first and second longitudinal ends; the first end of the first stub shaft is connected to and movable with the rotor; the second end of the first stub shaft has a flat face provided with a plurality of cylindrical lug receiving openings eccentrically disposed about the face.

The second stub shaft has a longitudinal axis which is substantially colinear with the axis of the stator and first and second longitudinal ends; the second stub shaft is supported in the housing so that its longitudinal axis is fixed and the second stub shaft is rotatable about its longitudinal axis; the second end of the second stub shaft has a flat face provided with a plurality of cylindrical lug receiving openings eccentrically disposed about the face.

The offset cam lug members each include first and second cylindrical lug portions The first and second lug portions each have a longitudinal axis; the axes of the first and second lug portions are parallel and offset by a distance equal to the radius of the orbit of the true center of the rotor about the axis of the stator. The first lug portion of each lug member is rotatably received in one of the lug receiving openings provided in the first stub shaft and the second lug portion of each lug member is rotatably received in one of the lug receiving openings provided in the second stub shaft.

By virtue of this construction, the lug members couple the first and second stub shafts so that the first stub shaft can rotate about its axis and orbit about the axis of the second stub shaft at the same time the second stub shaft rotates about its longitudinal axis. Since the rotor is limited to orbiting about the center of the stator at a precisely known distance which can not be varied, the coupling precisely controls the position of the rotor.

This coupling makes it possible to significantly shorten the overall length of the pump or motor; the length can be less than one-tenth that of a comparable universal joint coupling. This reduced length is particularly significant in down hole motors because it allows greater bends in directional drilling.

As described above, the drive train of the present invention includes a progressive cavity device and a cam coupling. The progressive cavity driving device includes the stator, the cavity within the stator, the rotor within the stator cavity, and a passageway for flowing fluids through the stator. The cam coupling includes the offset stub shafts and offset lug members coupling the stub shafts. When used as a fluid motor, the rotor produces a rotor driving motion responsive to the flow of fluids through the stator cavity, the cam coupling is secured to the end of the rotor projecting from the fluid discharge end of the stator. Flow of fluids through the progressive cavity device rotates the rotor with respect to the stator. The cam coupling converts the rolling of the rotor into a rotational motion substantially about a single axis at the same speed.

The present invention also provides an improved drilling apparatus which includes a drill string, a progressive cavity device, a cam coupling and a drill bit. The progressive cavity device is connected to the lower end of the drill string and includes a stator, a rotor within the stator, and means for flowing fluids through the stator to drive the rotor. The cam coupling has a first stub shaft and a second stub shaft and a plurality of offset lug members. The first stub shaft has a plurality of circumferentially spaced cylindrical lug receiving openings. and the second stub shaft has a plurality of similarly spaced cylindrical lug receiving openings. Each lug member has a first cylindrical lug having an axis and a second cylindrical lug having an axis which is offset from the axis of the first lug; the first lug is received in a lug receiving opening in the first stub shaft and the second lug is received in a lug receiving opening in the second stub shaft. The first end of the cam coupling is attached to the rotor and has an axis which is aligned with the true center of the rotor for rotation therewith. The drill bit has a tubular housing connected to the second end of the cam coupling for rotation with the second stub shaft. The cam coupling converts the complex rotor motion into rotational drilling motion about an axis displaced from and parallel to said rotor axis.

Another aspect of the present invention is the provision of a pumping apparatus which includes a housing structure, a progressive cavity device, and a cam coupling and a drive means. The housing structure has a fluid inlet portion, a fluid outlet portion and a passageway communicating the fluid inlet portion with the fluid outlet portion. The progressive cavity device is mounted in the passageway; it includes a stator having a longitudinal axis and a rotor located within the stator and having a true center. The stator and the rotor have coacting helical lobes in contact with one another at any transverse section. The stator has one more helical lobe than the rotor such that a plurality of cavities are defined between the rotor and the stator. The rotor is adapted to rotate within the stator such that the true center of the rotor orbits the axis of the stator at a predetermined radius. The orbit causes a progression of the cavities in the direction of the stator from the inlet through the passageway to the outlet. Because the amount of offset is precisely predetermined and fixed, the movement of the rotor is precisely controlled so that the progression of cavities is controlled and performance is optimized.

The cam coupling includes a first stub shaft, a second stub shaft and a plurality of offset lug members, the first stub shaft has a plurality of circumferentially spaced cylindrical lug receiving openings and the second stub shaft has a plurality of similarly spaced cylindrical lug receiving openings. Each lug member has a first cylindrical lug having an axis and a second cylindrical lug having an axis which is offset from the axis of the first lug. The first lug is received in a lug receiving opening in the first stub shaft and the second lug is received in a lug receiving opening in the second stub shaft. The first stub shaft is attached to the rotor and its axis is aligned with the true center of the rotor for rotation therewith. The second stub shaft is operatively connected to a motor, engine or other drive means for causing rotation of the second stub shaft. The rotation of the second stub shaft is converted by the coupling and progressive cavity device into a progression of the cavities in the passageway from the inlet end to the outlet end.

Regardless of its application, the drive train of the present invention can include sleeve bearings provided on each of the cylindrical lugs, sleeve bearings in each of the lug receiving openings, and/or a rubber sealing boot to protect the cam coupling from its environment and/or retain lubricant in the vicinity of the cam coupling.

BRIEF DESCRIPTION OF THE DRAWINGS

Other objects, features, and advantages of the present invention are hereinafter set forth and explained with reference to the drawings wherein.

DETAILED DESCRIPTION OF THE DRAWINGS

Figure 1:
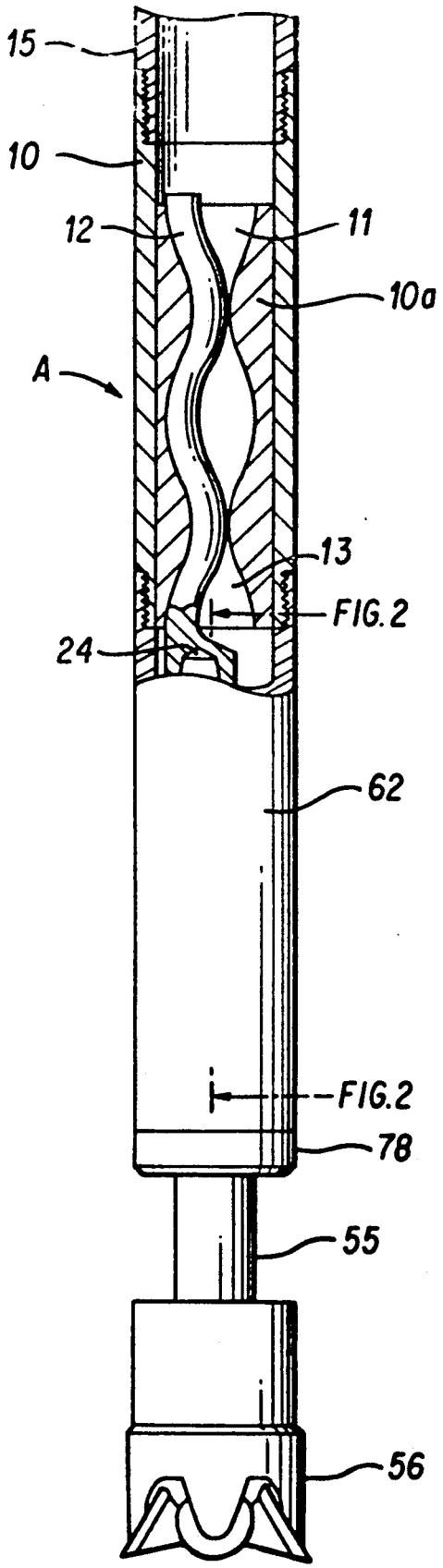
FIG. 1 is an elevation view partly in section of the overall structure of an embodiment of the present invention applied to a drilling apparatus.

FIG. 1 shows the overall structure of an embodiment of the progressive cavity drive train of the present invention used in a progressive cavity drilling apparatus. The drive train of the present invention comprises a progressive cavity device and a cam coupling for converting the motion of the rotor of the progressive cavity device, i.e., orbiting of the rotor and the rotational motion of the rotor, into rotation about a single axis at the same speed.

As illustrated in FIG. 1, the progressive cavity device A has a stator, a rotor, a passageway for fluid to enter between the stator and the rotor, and a passageway for the fluid to exit therefrom. In the drawings, the housing 10 and its flexible lining 10*a* are held against movement so that they function as the stator in the device A and the shaft 12 functions as the rotor. The housing 10 is tubular and its interior communicates with inlet in the top portion of the lining 10*a* to provide a passageway for fluid to enter the progressive cavity device A. Outlet 13 in the bottom portion of the lining 10*a* serves as the passageway for fluid to discharge from the progressive cavity device A. The shaft 12 is precisely controlled so as to roll within the lining 10*a*. The progressive cavity device A is attached to the lower end of a drill string 15 Numeral 62 is another portion of the housing and numerals 78,55 and 56 are conventional drilling components.

With reference to FIGS. 2–7 inclusive, the cam coupling device includes a first stub shaft 22 attached to or continuous with the rotor and aligned with the true center 28 of the rotor 12 for rotation therewith and a second stub shaft 24 in engagement with or continuous with a rotatable shaft, e.g., a drill bit drive shaft or a pump motor shaft, which rotates about a single axis. The first and second stub shafts 22, 24 have axes of rotation which are substantially parallel but offset from one another by a distance d corresponding to the radius of the orbit of the true center 28 of the rotor about the axis of the second stub shaft 24. A plurality of offset cam lug members 23 couple the first and second shafts.

Generally, the second stub shaft 24 is the shaft which rotates without orbiting; it is either mounted for rotation by bearings or coupled to a shaft which is so mounted. The first stub shaft is left free since it orbits as well as rotates. The center of the orbit of the first stub shaft lies on the axis of rotation of the second stub shaft 24. The radius of orbit of the first stub shaft is precisely controlled. As noted above, the radius of this orbit is equal to the predetermined distance d of offset between the first and second stub shafts. It should be noted that the stub shafts do not have to have the shape illustrated in the drawings In fact, the stub shafts can have virtually any shape so long as they can be coupled to one another as described below. For example, the stub shafts could be very short (e.g. shorter than the radius of their face or they could be elongated as when they are formed integrally with another element of the drive train. Generally, the shape of the stub shafts will be dictated by the means employed to connect the stub shafts to the other elements of the drive train, e.g. the rotor and rotatable shaft.

Figure 4A:
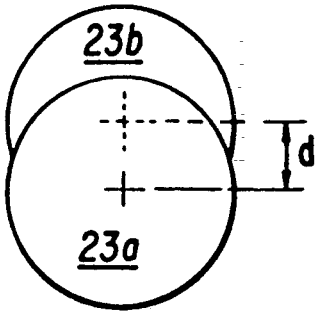
FIGS. 4(A), (B) and (C) are front, perspective and side views of a first offset lug member used in the present invention.
Figure 4B:
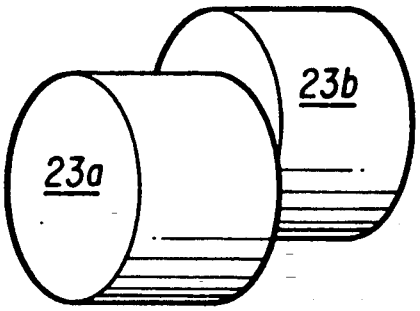
Figure 4C:
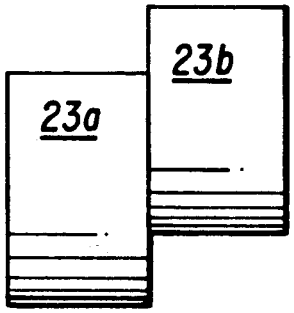

As best shown in FIGS. 4(A)–4(C), each cam lug member 23 comprises a first cylindrical lug portion 23*a* having a first lug axis and a second cylindrical lug portion 23*b* having a second lug axis. The axes of rotation of the first and second lug portions are defined by the axes of the respective cylindrical portions These axes are offset by a distance d equal to the predetermined distance between the axes of the first and second stub shafts; the distance d is fixed so that the amount of offset is precisely controlled without exception or variation.

Figure 5A:
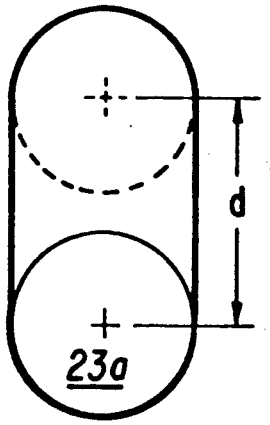
FIGS. 5(A), (B) and (C) are front, perspective and side views of an alternative offset lug member used in the present invention.
Figure 5B:
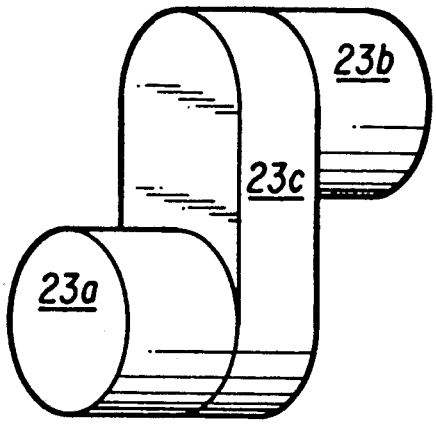
Figure 5C:
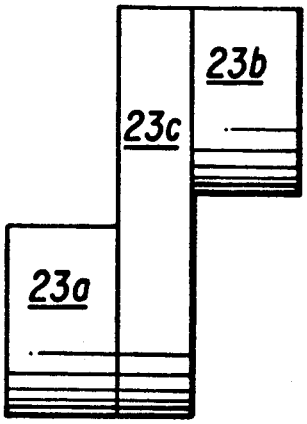

As shown in FIGS. 5(A)–(C), the cam lugs may also include a spacer portion 23*c* between the cylindrical portions to increase the amount of offset d. This type of lug should generally be used when the desired offset distance d exceeds the radius of the cylindrical portions and must be used if the distance d exceeds the diameter of the cylindrical portions; in such cases, there is insufficient overlap of the cylindrical portions 23*a*, 23*b* to ensure a structurally sound connection between these two portions (23*a*, 23*b*) above.

Figure 6:
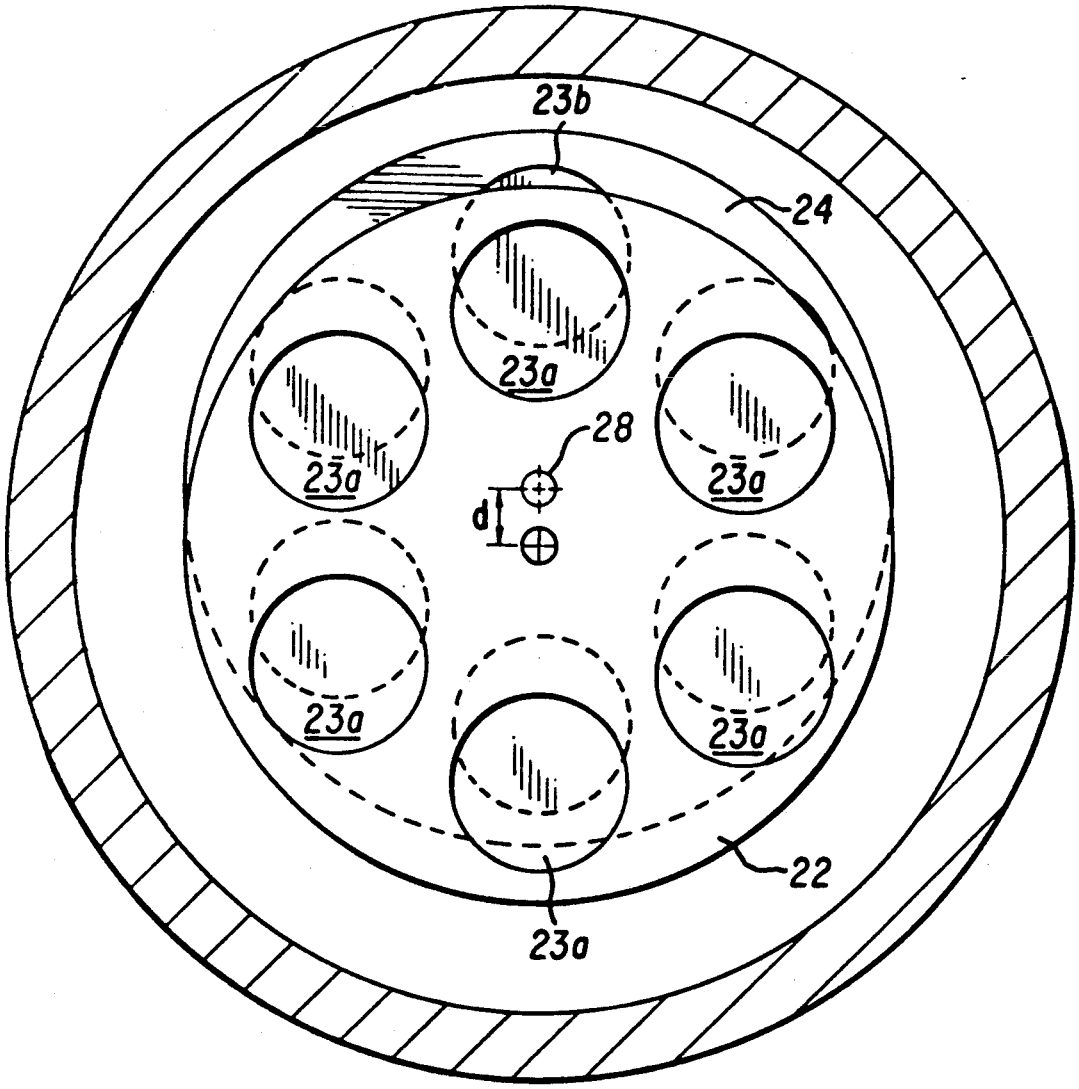
FIG. 6 is a diagrammatic illustration of the offset relationship of the stub shafts of the present invention.

Each of the stub shafts is provided with a number of lug receiving openings on their opposed faces; the number of such openings must be at least equal to the number of offset cam lugs to be used to couple the stub shafts. As best shown in FIG. 6, the lug receiving openings are eccentrically arranged along a common circle about the axis of rotation of the stub shaft. The arrangement of openings on the opposed shaft faces should be symmetrical so that the lugs can properly couple the stub shafts Preferably, the openings are circumferentially spaced about each stub shaft face to ensure balanced loading.

When assembled, the first cylindrical portion 23*a* of each offset cam lug 23 is received in one of the lug receiving openings in the face of the first stub shaft 22 and the second cylindrical portion 23*b* is received in a corresponding opening in the face of the second stub shaft 24.

The openings may be journaled to the desired quality of finish or bearing sleeves 25 may be inserted to ensure smooth rotation Similarly, the cylindrical portions of the lugs may be finished or capped with bearing rings (not shown). In the embodiment illustrated in FIG. 3, bearing sleeves 25 are inserted into the lug receiving openings in the stub shafts.

As an alternative to coupling the offset stub shafts with lug members of the type described above, it is possible to provide the stub shafts with cylindrical protrusions rather than cylindrical lug receiving openings. In such a case, the lug members would be provided with cylindrical recesses rather than cylindrical protrusions. The cylindrical protrusions of the stub shafts would then be received in the recesses in the lugs.

Figure 8B:
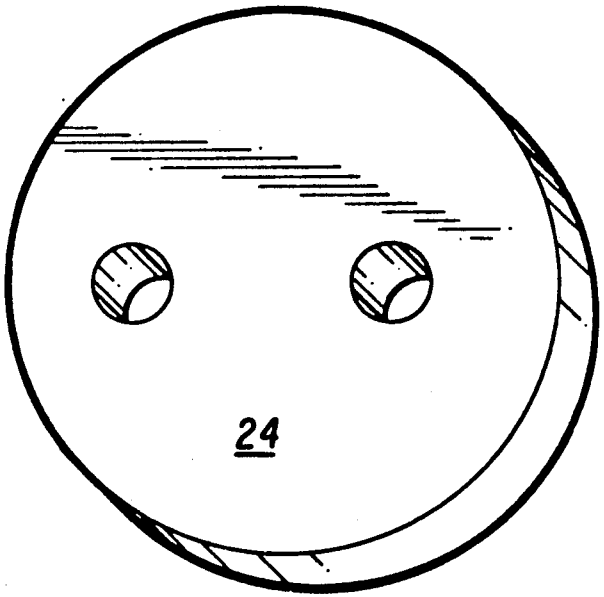
FIGS. 8(A), 8(B), and 8(C) are perspective views of the component parts of an alternative coupling device.
Figure 8C:
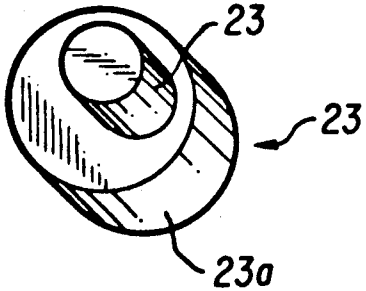
Figure 8A:
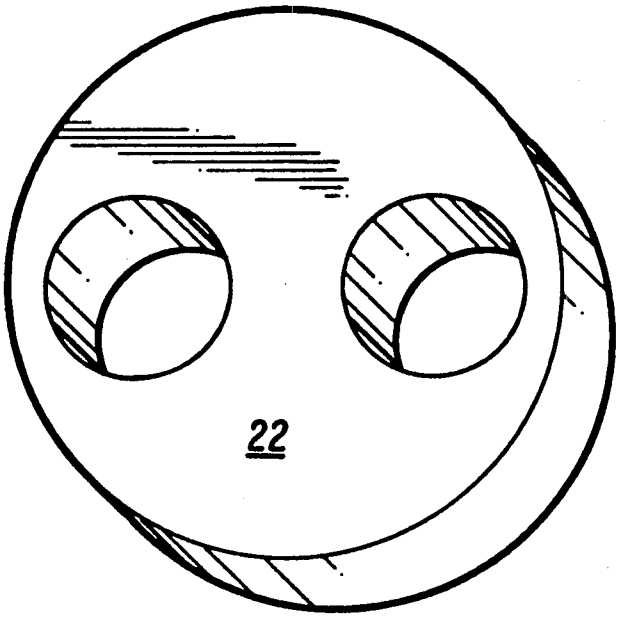

FIGS. 8(A)–8(C) illustrate a different form of coupling which can be used in the drive train of the present invention. As with the previously described coupling, this coupling comprises a first stubshaft 22, a second stubshaft 24 and a plurality of offset lug members 23 (only one shown in FIG. 8(C)). Also, each of the stubshafts is provided with a plurality of lug receiving openings on their opposed faces; the number of such openings must be at least equal to the number of offset cam lugs to be used to couple the stubshafts. As best shown in FIGS. 8(A) and 8(B), the lug receiving openings are eccentrically arranged around a common circle about the axis of rotation of the stubshaft 22, 24. The arrangement of the openings on the opposed shaft faces should be symmetrical so that the lugs can properly couple the stubshafts. Preferably, the openings are circumferentially spaced about each stubshaft to ensure balanced loading As can be seen from a comparison of FIGS. 8(A) and 8(B), the lug receiving openings formed in the first stubshaft 22 are significantly larger than the lug receiving openings formed on the second stubshaft 24. This disparity of size of the lug receiving openings allows the stubshafts to be coupled by the lug member shown in FIG. 8(C). As shown in FIG. 8(C), the lug member 23 includes a first cylindrical portion 23A and a second cylindrical portion 23B. The first cylindrical portion is adapted to be rotatably received in the lug receiving openings in the first stubshaft and is sized accordingly; the second cylindrical portion 23B is adapted to be rotatably received in the lug receiving openings formed in the second stub shaft 24 and is sized accordingly. Thus, the first cylindrical portion 23A is significantly larger than the second cylindrical portion 23B. In fact, the second cylindrical portion 23B, as viewed in FIG. 8(C), is in effect a cylindrical protrusion from the face of the first cylindrical portion 23A. Each of the cylindrical portions 23A, 23B has a longitudinal axis, i.e., the axis of the cylinder. The axis of the second cylindrical portion 23B is offset from the axis of the first cylindrical portion 23A by a predetermined distance d which corresponds to the offset of the true center of the rotor from the axis the stator. Like the other embodiments of the present invention, the distance d is fixed so that the amount of offset is precisely controlled without exception or variation.

The lug receiving openings and/or the cylindrical portions of the lugs 23 may be journaled to a desired quality of finish to ensure smooth rotation between the cylindrical portions and the lug receiving openings. Alternatively, the cylindrical portions of the lugs may be capped with bearing sleeves or bearing sleeves may be inserted into the lug receiving openings to ensure smooth rotation.

Figure 9B:
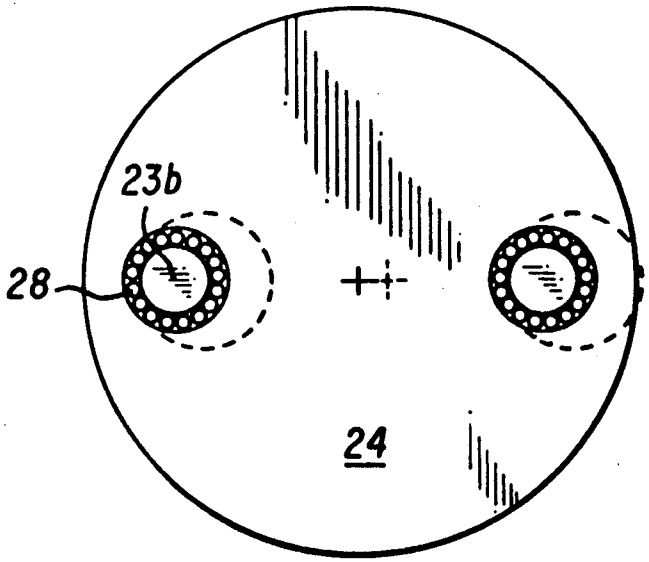
FIGS. 9(A), 9(B) and 9(C) are top views of the component parts of another alternative coupling device.
Figure 9C:
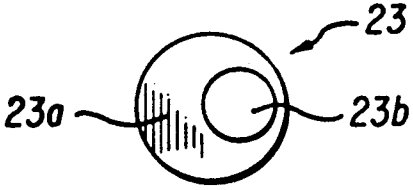
Figure 9A:
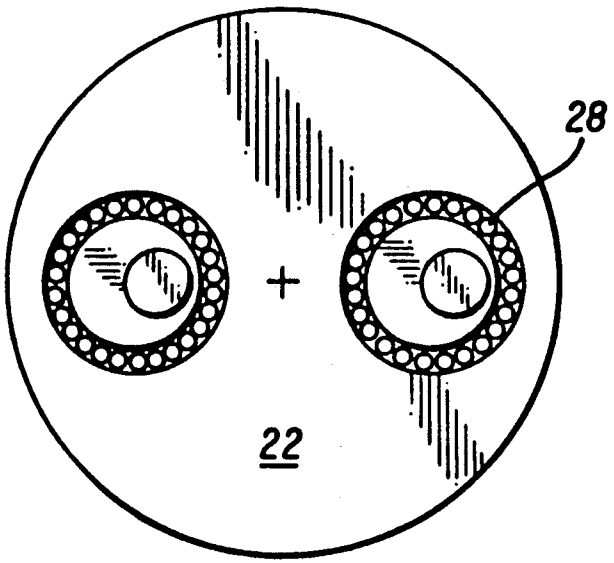

FIGS. 9(A)–9(C) illustrate an alternative coupling structure. The structure shown therein is quite similar to that shown in FIGS. 8(A)–(C); in fact, the lug member shown in FIG. 9(C) is essentially identical to the lug member shown in FIG. 8(C). However, the coupling shown in FIGS. 9(A)–9(C) differs from that shown in FIGS. 8(A)–8(C) in that the lugs are rotatably supported in the lug receiving openings by a series of roller bearings 28. The provision of the roller bearings 28 significantly reduces rotating friction between the cylindrical portions 23(A), 23(B) of the lug 23. Preferably, the cylindrical bearings 28 are provided in the lug receiving openings in both the first stub shaft 22 and the second stub shaft 24 as shown in FIGS. 9(A) and 9(B). This construction ensures extremely smooth rotation of the lugs 23 within the lug receiving openings and consequently results in a very smooth conversion of the complex motion of the first stub shaft 22 to simple rotation of the second stubshaft 24.

When the progressive cavity train of the present invention is used as a fluid motor or driving apparatus (as it is in the drilling apparatus shown in FIG. 1), a pressurized fluid, typically water carrying suspended particles commonly referred to as "mud", is forced into the progressive cavity device. The rotor 12 responds to the flowing fluid to produce a rotor driving motion which is simultaneously a rotation, an oscillation, and a orbit. The cam coupling attached to the rotor 12 and aligned with the true center 28 of the rotor described above converts this rotor driving motion into rotational driving motion substantially about a single axis. The length of the cam coupling can be less than one-tenth the length of a comparable universal joint Consequently, the overall motor length can be significantly shortened by using the drive train of the present invention This is very important in directional drilling where length limits bending.

Figure 2:
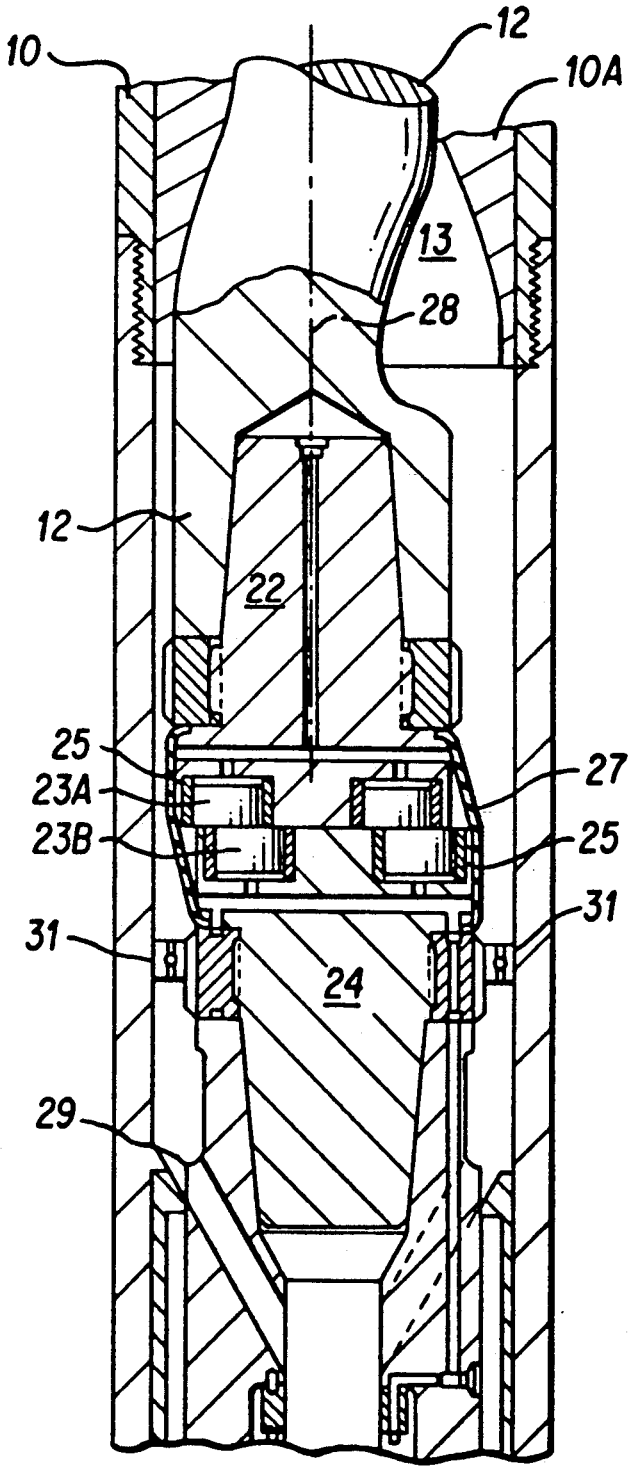
FIG. 2 is a partial transverse cross section along the lines indicated in FIG. 1.
Figure 3:
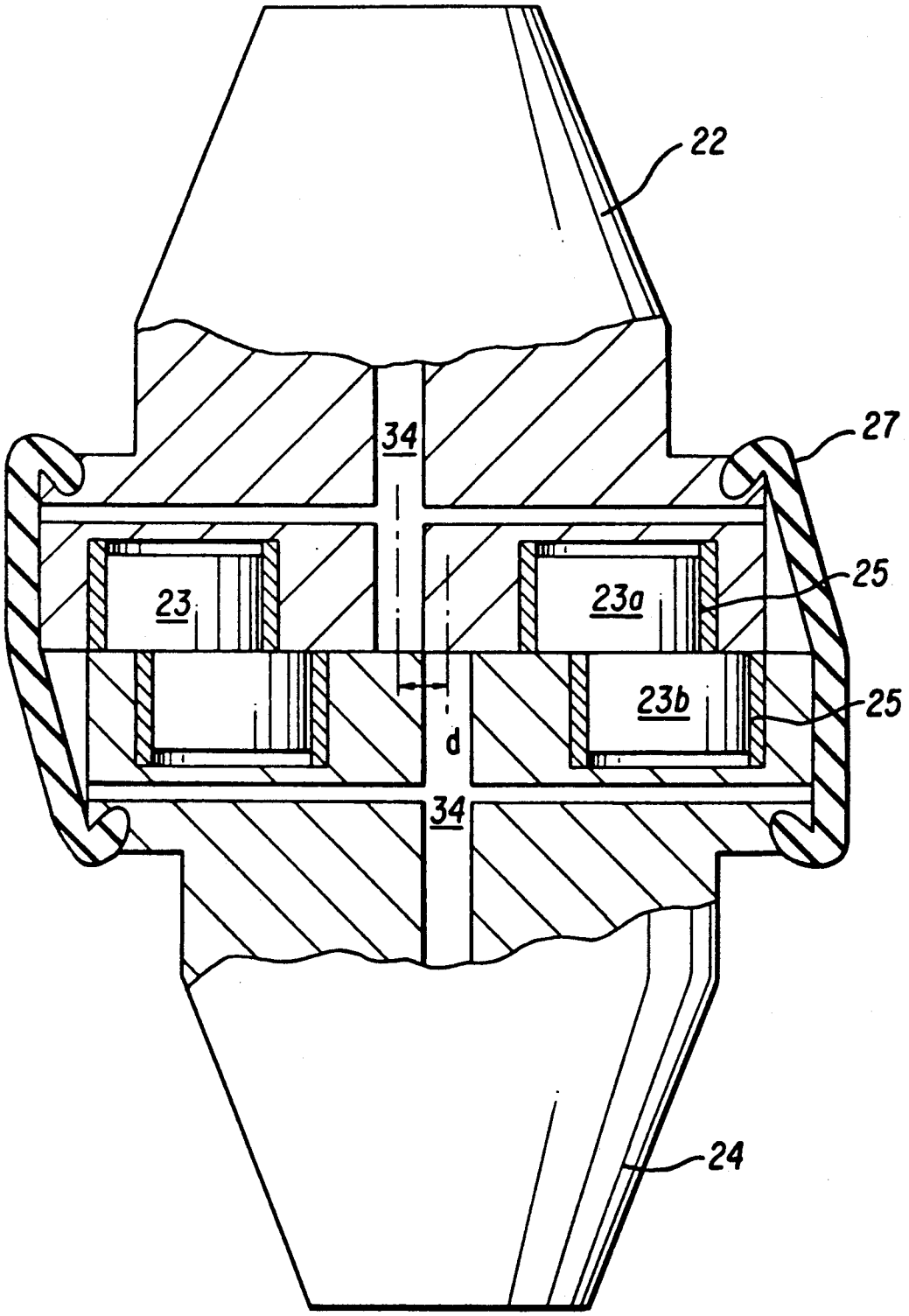
FIG. 3 is a partially sectional detail view of the offset cam coupling used in the present invention.

To prevent abrasion of the cam coupling elements and the driver shaft element caused by foreign matter contained in the driving fluid or mud, various sealing structures are provided. As best shown in FIGS. 2 and 3, a flexible boot 27, preferably constructed of a reinforced flexible material such as reinforced rubber, encloses the interface of the stub shafts 22, 24 and the lug members 23, i.e., the interface region. The boot 27 is sufficiently flexible and durable to accommodate the repeated orbiting motion of the first stub shaft 22. The boot may be secured to any appropriate portion of the periphery of the stub shafts 22, 24. In the illustrated embodiment, the boot is secured in grooves formed in the periphery of the stub shafts 22, 24 adjacent the coupling wrench nuts 26. In addition to preventing the entry of abrasive fluid into the coupling mechanism, the boot 27 serves as lubricating oil seal to provide a flexible chamber for the retention of lubricating oil in the interface region of the coupling mechanism.

The portion of the drilling apparatus driven by the drive train of the present invention can be of conventional construction.

The operation of a drilling or driving apparatus incorporating the drive train of the present invention begins with a fluid flow through inlet 11 in the housing 10 thereby contacting the rotor 12. Responsive to the flow of this fluid, the rotor 12 rotates The first stub shaft 22, which is attached to the rotor and aligned with its true center 28, moves with the rotor 12. The motion of the first stub shaft 22 is converted by the cam coupling into rotational driving motion of the second stub shaft 24 about a single axis. This rotation is transmitted to the drill bit 56 through any known drive line; in the embodiment illustrated, a hollow drive shaft is used.

Figure 7:
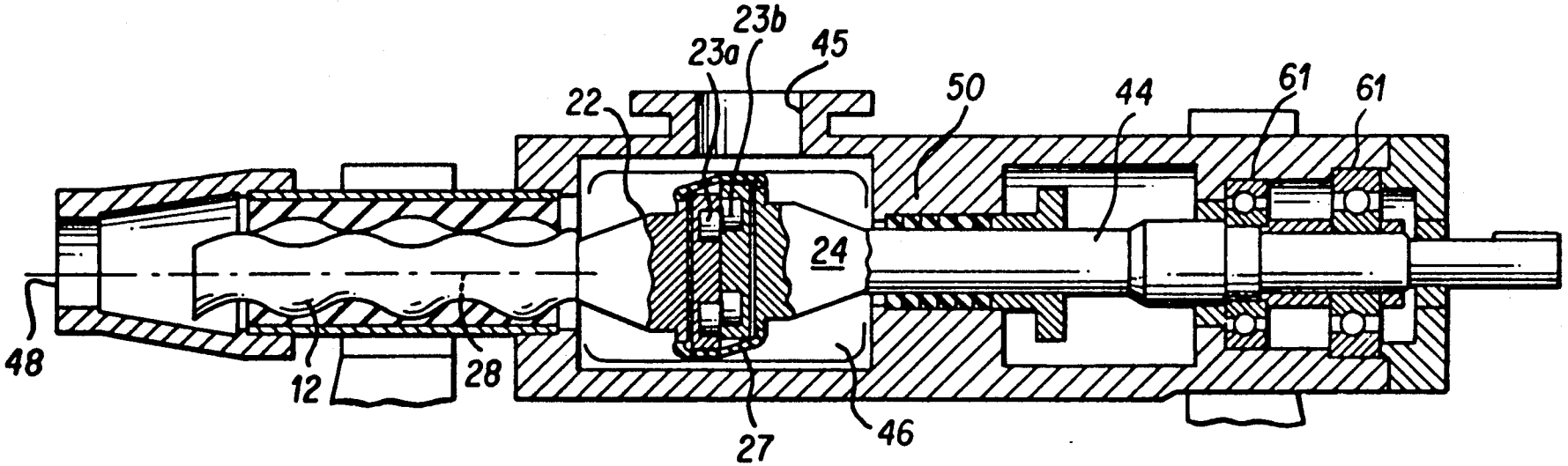
FIG. 7 is an elevation view, partly in section, of the overall structure of another embodiment of the present invention, in this case applied to a pumping apparatus. Numeral 62 is another portion of the housing and numerals 78, 55 and 56 are conventional drilling components.

The improved drive train may of course be used in a progressive cavity pumping apparatus. Such a construction is illustrated in FIG. 7. The progressive cavity device again includes a rotor 12, a stator 10, and a cam coupling device 22, 23, 24. In this case, however, the cam coupling device converts the rotational driving motion of a drive shaft 44 into complex rotation and orbiting of the stator 12 so as to cause a pumping action within the progressive cavity device. The apparatus also includes a fluid inlet port 45 to allow fluid to enter a pumping chamber 46 and thereafter to enter between rotor 12 and stator 10 to be pressurized, i.e. pumped by the progressive cavity device. An outlet 48 for the pressurized fluid in chamber 46 is provided at the outlet of the progressive cavity device. It is preferred that the housing and its flexible lining be the stator and the shaft be the rotor, with the rotor being adapted to roll within the housing so as to produce a rotor pumping motion. Because the motion of the rotor is precisely controlled by the coupling, the rolling of the rotor in the stator and consequent pumping action can be optimized. A drive means such as an engine or motor transmits rotation to the second stub shaft; this rotation is converted by the cam coupling into pumping movement of the rotor in the manner described above.

The pumping apparatus also includes conventional features such as a seal 50 for sealing the drive shaft 44 and bearings 61 for rotatably supporting the drive shaft 44.

What is claimed is:

1. A progressive cavity drive train comprising:

a housing structure a stator, the stator having a longitudinal axis;

a rotor having a true center, the rotor being located within the stator;

the stator and the rotor each having coacting helical lobes which are in contact with one another at any transverse section, the stator having one more helical lobe than the rotor such that a plurality of cavities are defined between the rotor and the stator, and the rotor being adapted to rotate within the stator such that the true center of the rotor orbits the axis of the stator, the orbit having a predetermined radius and the orbit causing a progression of the cavities in the direction of the axis of the stator;

a first stub shaft having a longitudinal axis and first and second longitudinal ends, the first end of the first stub shaft being connected to and movable with the rotor, the second end of the first stub shaft comprising a flat face provided with a plurality of cylindrical lug receiving openings eccentrically disposed about the face;

a second stub shaft having a longitudinal axis which is substantially colinear with the axis of the stator and first and second longitudinal ends, the second stub shaft being rotatably mounted about its longitudinal axis within the housing structure, the second end of the second stub shaft comprising a flat face provided with a plurality of cylindrical lug receiving openings eccentrically disposed about the face; and a plurality of offset cam lug members, each lug member comprising first and second cylindrical lug portions, the first and second lug portions each having a longitudinal axis and the axes of the first and second lug portions being parallel and offset by a distance equal to the radius of the orbit of the true center of the rotor about the axis of the stator, the first lug portion of each lug member being rotatably received in one of the lug receiving openings provided in the first stub shaft and the second lug portion of each lug member being rotatably received in one of the lug receiving openings provided in the second stub shaft;

whereby the lug members couple the first and second stub shafts such that the first stub shaft can rotate about its axis and orbit about the axis of the second stub shaft at the same time the second stub shaft rotates about its longitudinal axis.

2. The progressive cavity drive train of claim 1, wherein the first stub shaft is integrally connected with the rotor.

3. The progressive cavity drive train of claim 1, wherein the first stub shaft is connected to the rotor by a coupling wrench nut.

4. The progressive cavity drive train of claim 1, wherein the second stub shaft is rotatably supported in the housing structure by bearings.

5. The progressive cavity drive train of claim 1, further comprising a rotatable shaft rotatably mounted in the housing structure by bearings, the second stub shaft being secured to the rotatable shaft.

6. The progressive cavity drive train of claim 1 wherein one of the first and second lug portions of the lug members is larger than the other portion and the other portion protrudes from a flat face of the one portion.

7. The progressive cavity drive train of claim 1 further comprising a plurality of roller bearings rotatably supporting the lug members in at least one of the lug receiving openings formed in the first stub shaft and the lug receiving openings formed in the second stub shaft.

8. The progressive cavity drive train of claim 1 further comprising a drill bit operatively connected to and driven by the second stub shaft.

9. The progressive cavity drive train of claim further comprising a fluid inlet proximate the end of the rotor to which the first stub shaft is connected and a fluid outlet proximate the opposite longitudinal end of the rotor and wherein the second stub shaft drives the rotor through the lug members and the first stub shaft to pump fluid from the inlet to the outlet.

10. A drilling apparatus comprising, a drill string;

a progressive cavity device connected to the lower end of the drill string and comprising a stator having a longitudinal axis, a rotor within the stator, the rotor having a true center, and a passageway for flowing fluids through the stator to drive the rotor so as to cause the true center of the rotor to rotate and orbit about the axis of the stator;

a cam coupling having first and second ends, a first stub shaft at the first end and a second stub shaft at the second end, the first stub shaft having a plurality of circumferentially spaced cylindrical lug receiving openings and the second stub shaft having a plurality of similarly spaced cylindrical lug receiving openings, a plurality of offset lug members, each lug member comprising a first cylindrical lug having an axis and a second cylindrical lug having an axis which is offset from the axis of the first lug, the first lug being received in a lug receiving opening in the first stub shaft and the second lug being received in a lug receiving opening in the second stub shaft;

wherein the first stub shaft of the cam coupling is attached to the rotor and has its axis aligned with the true center of the rotor for rotation therewith; and a drill bit having a tubular housing connected to the second stub shaft of the cam coupling so as to rotate with the second stub shaft;

whereby the cam coupling converts rotor orbiting and rotation into rotational drilling motion about an axis displaced from and parallel to said rotor axis.

11. The drilling apparatus of claim 10, wherein the first lug and the second lug are spaced apart a distance equal to the radius of the orbit of the true center of the rotor about the axis of the drill bit shaft.

12. The drilling apparatus of claim 10, further comprising a rubber boot having a first end sealingly secured to the first stub shaft and a second end sealingly secured to the second stub shaft so that the rubber boot substantially seals the offset lugs from the remainder of the drilling apparatus.

13. The drilling apparatus of claim 10 further comprising a plurality of roller bearings rotatably supporting the lug members in at least one of the lug receiving openings formed in the first stub shaft and the lug receiving openings formed in the second stub shaft.

14. The pumping apparatus of claim 1 wherein one of the first and second lug portions of the lug members is larger than the other portion and the other portion protrudes from a flat face of the one portion.

15. A pumping apparatus comprising:

a housing structure having a fluid inlet portion, a fluid outlet portion and a passageway communicating the fluid inlet portion with the fluid outlet portion;

a progressive cavity device mounted in the passageway, the progressive cavity device comprising a stator, having a longitudinal axis; a rotor having true center, the rotor being located within the stator; the stator and the rotor having coacting helical lobes which are in contact with one another at any transverse section; the stator having one more helical lobe than the rotor such that a plurality of cavities are defined between the rotor and the stator; whereby the rotor is adapted to rotate within the stator such that the true center of the rotor orbits the axis of the stator, the orbit having a predetermined radius and the orbit causing a progression of the cavities in the direction of the stator from the inlet through the passageway to the outlet;

a cam coupling having a first stub shaft and a second stub shaft, the first stub shaft having a plurality of circumferentially spaced cylindrical lug receiving openings and the second stub shaft having a plurality of similarly spaced cylindrical lug receiving openings, a plurality of offset lug members, each lug member comprising a first cylindrical lug having an axis and a second cylindrical lug having an axis which is offset from the axis of the first lug, the first lug being received in a lug receiving opening in the first stub shaft and the second lug being received in a lug receiving opening in the second stub shaft; and wherein the axis of the first stub shaft is aligned with the true center of the rotor and the first stub shaft is attached to the rotor for rotation therewith such that when the second stub shaft is rotated, the rotation is converted by the coupling and progressive cavity device into a progression of cavities in the passageway from the inlet end to the outlet end.

16. The pumping apparatus of claim 15, wherein the first lug and the second lug are spaced apart a distance equal to the radius of the orbit of the true center of the rotor about the axis of the second stub shaft.

17. The pumping apparatus of claim 15, further comprising a rubber boot having a first end sealingly secured to the first stub shaft and a second end sealingly secured to the second stub shaft so that the rubber boot substantially seals the offset lugs from the remainder of the pumping apparatus.

18. The pumping apparatus of claim 15 wherein one of the first and second lug portions of the lug members is larger than the other portion and the other portion protrudes from a flat face of the one portion.

19. The pumping apparatus of claim 15 further comprising a plurality of roller bearings rotatably supporting the lug members in at least one of the lug receiving openings formed in the first stub shaft and the lug receiving openings formed in the second stub shift.

* * * * *